US011938391B2

(12) United States Patent
McFarlane

(10) Patent No.: US 11,938,391 B2
(45) Date of Patent: Mar. 26, 2024

(54) TRAINING PAD

(71) Applicant: Daniel McFarlane, Sunderland (GB)

(72) Inventor: Daniel McFarlane, Sunderland (GB)

( * ) Notice: Subject to any disclaimer, the term of this patent is extended or adjusted under 35 U.S.C. 154(b) by 723 days.

(21) Appl. No.: 16/963,459

(22) PCT Filed: Jan. 22, 2019

(86) PCT No.: PCT/GB2019/050159
§ 371 (c)(1),
(2) Date: Jul. 20, 2020

(87) PCT Pub. No.: WO2019/145692
PCT Pub. Date: Aug. 1, 2019

(65) Prior Publication Data

US 2021/0046368 A1 Feb. 18, 2021

(30) Foreign Application Priority Data

Jan. 23, 2018 (GB) ..... 1801062

(51) Int. Cl.
*A63B 69/26* (2006.01)
*A63B 69/32* (2006.01)
(Continued)

(52) U.S. Cl.
CPC ..... *A63B 69/26* (2013.01); *A63B 69/322* (2022.08); *A63B 71/12* (2013.01); *A63B 71/14* (2013.01);
(Continued)

(58) Field of Classification Search
CPC ..... A63B 69/20–305
See application file for complete search history.

(56) References Cited

U.S. PATENT DOCUMENTS 694,335 A * 2/1902 Thenan et al. ..... A63B 69/34 194/252
1,624,129 A * 4/1927 Barrett ..... A63B 71/1225 2/22
(Continued)

FOREIGN PATENT DOCUMENTS

CN 104874169 A 9/2015
EP 3192573 A1 7/2017
(Continued)

OTHER PUBLICATIONS

All-Nice "Elbow Sleeve Pad", Amazon.com, Oct. 17, 2017, 7 pages, https://www.amazon.com/Elbow-Sleeve-Pad-Compression-Basketball/dp/B074X9WVM9psc=1&SubscriptionId=AKIAI3UJXNKQSHF57B4A&tag=t4m00-20&linkCode=xm2&camp=2025&creative=165953&creativeASIN=B074X9WVM9. Accessed Jul. 10, 2018.

*Primary Examiner* — Nyca T Nguyen
(74) *Attorney, Agent, or Firm* — Mueting Raasch Group

(57) ABSTRACT

The present invention provides a training pad for preventing injury to a trainer, in particular a boxing trainer, when presenting the training pad for striking, and further provides a focused location for receiving repeated strikes, comprising a target pad having a target surface and a resiliently deformable region located behind the target surface, and a securing member configured to secure the target pad to a first arm segment adjacent to a second arm segment. The first arm segment is proximal to the second arm segment. The resiliently deformable region is arranged to substantially absorb the energy of a strike received at the target surface, and the target surface is configured to indicate to a user a strike may be made thereon.

8 Claims, 6 Drawing Sheets

(51) Int. Cl.
*A63B 71/12* (2006.01)
*A63B 71/14* (2006.01)
*A63B 71/06* (2006.01)

(52) U.S. Cl.
CPC ... *A63B 2071/0661* (2013.01); *A63B 2209/00* (2013.01); *A63B 2209/10* (2013.01); *A63B 2220/801* (2013.01); *A63B 2225/50* (2013.01); *A63B 2244/102* (2013.01)

(56) References Cited

U.S. PATENT DOCUMENTS 3,446,880 A * 5/1969 Enicks ..... A63B 71/08 2/24
3,911,497 A * 10/1975 Lewis, Jr. ..... A41D 13/08 2/24
4,344,189 A * 8/1982 Futere ..... A41D 13/08 2/16
4,393,520 A * 7/1983 Koch ..... A47D 13/086 5/655
4,546,966 A * 10/1985 Segura ..... A63B 69/26 482/88
4,565,366 A * 1/1986 Struss ..... A63B 69/32 482/84
4,756,026 A * 7/1988 Pierce, Jr. ..... A63B 71/1225 2/24
4,942,624 A * 7/1990 Cho ..... A63B 71/08 2/24
4,946,159 A * 8/1990 Jones ..... A63B 69/004 473/441
5,405,312 A * 4/1995 Jacobs ..... A41D 13/0568 128/892
5,501,649 A * 3/1996 Queppet ..... A63B 69/004 482/88
5,507,720 A * 4/1996 Lampropoulos ... A63B 71/1225 602/65
D370,507 S * 6/1996 Kha ..... A63B 71/1225 D21/798
5,964,683 A * 10/1999 Norblom ..... A63B 71/145 482/88
6,063,011 A * 5/2000 Pelchat ..... A63B 69/004 482/90
6,412,114 B1 * 7/2002 Carlin ..... A63B 71/12 2/22
7,824,316 B2 * 11/2010 Wang ..... A63B 69/305 482/83
9,079,092 B2 * 7/2015 Stack ..... A63B 69/004
9,254,429 B1 * 2/2016 Gilman ..... A63B 69/26
9,320,954 B1 * 4/2016 Simpkins ..... A63B 69/004
9,814,959 B1 * 11/2017 Riera ..... A63B 69/004
10,293,234 B1 * 5/2019 Schlegel ..... A63B 69/34
10,835,795 B1 * 11/2020 Wilson ..... A63B 69/26
D932,576 S * 10/2021 Tanzini ..... A63B 69/004 D29/100
2003/0073548 A1 * 4/2003 Haselrig ..... A63B 69/305 482/83
2012/0180183 A1 7/2012 Mechling et al.
2013/0072330 A1 * 3/2013 Cohen ..... A63B 60/08 473/549
2013/0227755 A1 * 9/2013 Bisaillon ..... A41D 19/0048 2/161.1
2013/0296141 A1 * 11/2013 Partlo ..... A63B 71/0622 482/84
2015/0209641 A1 * 7/2015 Yevgeniyovych ..... A63B 69/20 482/83
2015/0375079 A1 * 12/2015 Wood ..... A63B 69/32 482/8
2017/0001091 A1 * 1/2017 Holmes ..... A63B 69/26
2019/0209907 A1 * 7/2019 Monk ..... A63B 69/20
2019/0344145 A1 * 11/2019 Rita ..... A63B 69/004
2020/0316365 A1 * 10/2020 Hyde ..... A61B 5/6804
2022/0001257 A1 * 1/2022 Rolle ..... A63B 71/14

FOREIGN PATENT DOCUMENTS

GB 2484405 A 4/2012
KR 20100135061 A 12/2010
WO 0179858 A1 10/2001

* cited by examiner

TRAINING PAD

This invention relates to a training pad used in training for sporting activities where a trainer presents the training pad for striking.

BACKGROUND

Combat sports, such as boxing, typically require athletes to have good speed, strength and accuracy so that they can strike their opponents whilst not being struck themselves. One method of improving the accuracy of athletes is for a trainer to use a pair of focus mitts, typically worn on the hands and having a target on a target surface, and sequentially present an athlete a target to strike. This may be done while in a sparring arrangement, which allows the athlete to improve the accuracy of their strikes whilst simulating the dynamic environment of competition.

One problem with prior art training pads, such as focus mitts, is the lack of variety in location of targets the trainer is able to present. Typically, the trainer will present the athlete with one or both targets at shoulder or head height, so that the athlete may strike the target by extending their arm to strike the target. The trainer may choose to contort their arms and torso so that additional targets may be provided at other heights, such as at waist height. However, as the athlete is effectively striking targets on the hands of the trainer, there is often a lack of resistance to the athlete, compared to the actual resistance experienced when hitting the body of an opponent. Such resistance may instead be provided by a larger punch bag held by the trainer. Whilst such targets can provide more resistance to the athlete's strike, a larger punch bag is typically attached to the arm of the trainer and held by at least one hand of the trainer to secure the punch bag when struck. This prevents the trainer from being able to utilise a punch bag and the focus mitts to provide a variety of targets to the athlete. Further, a punch bag is also much heavier than a focus mitt and is also only able to provide limited targets due to the lack of manoeuvrability of the heavier bag. Therefore, it is desirable to provide a training pad which can be worn by a trainer to provide a greater variety of targets at a greater variety of striking angles. It is also desirable to provide a training pad that is able to simulate body strikes on multiple locations, whilst allowing the trainer to remain mobile in order to retain the ability to simulate the dynamic environment of competition.

A further problem with having the trainer contort their arms and/or torso to provide a selection of targets is the risk of injury the trainer is exposing themselves to. Contorting the body in this manner requires the trainer to excessively straining their shoulder and back muscles, which may cause the trainer pain and discomfort both during and after the training session. There is also the considerable risk of injury the trainer is exposing themselves to when they absorb the energy of the strikes when in a contorted position. The biomechanically unfavourable position of the arms and torso may cause considerable forces to be exerted through the shoulders and spine of the trainer, and with repeated impacts, may lead to longer term problems for the trainer, such as excessive joint damage and degeneration. It would be desirable to provide a training pad that could be presented to an athlete for striking whilst the trainer is in a biomechanically stable position.

It is the object of the present invention to alleviate at least some of these problems.

BRIEF SUMMARY OF THE DISCLOSURE

Viewed from a first aspect, the present invention provides a training pad for preventing injury to a trainer, in particular a boxing trainer, when presenting the training pad for striking, comprising a target pad having a target surface and a resiliently deformable region located behind the target surface, and a securing member configured to secure the target pad to a first arm segment adjacent to a second arm segment. The first arm segment is proximal to the second arm segment. The resiliently deformable region is arranged to substantially absorb the energy of a strike received at the target surface. The target surface is configured to indicate to a user a strike may be made thereon.

This advantageously provides a trainer the ability to present multiple targets, in particular body shot targets having considerably more resistance than is provided for by existing mitts whilst requiring only a small amount of shoulder and elbow rotation. By substantially eliminating the need to contort the torso or arms, the trainer is able to present the multiple body shot targets having greater resistance for striking in a safe manner. As the target pad is located on an arm segment more proximal than the distal-most arm segment, the hand, such as the forearm or upper arm, the forces transferred to the arm of the trainer will be reduced compared to existing focus mitts which are attached to the distal-most arm segment, the hand. A further advantage of the present invention lies in the location of the target pad. By securing the target pad to an arm segment more proximal than the distal-most segment, such as the upper arm or the forearm, this enables a trainer to utilise a focus mitt or other training aid if they desire. Further still, the resiliently deformable target pad enables the trainer to present targets in previously unsafe locations, particularly where the trainer would need to contort their body to present the target. The energy absorption of the target pad allows the trainer to present targets for striking in a variety of locations and to absorb the striking force more than previously possible with a considerably reduced risk of injury. The target surface being configured to indicate to a user where to strike the training pad further reduces the risk of injury to the trainer, as strikes will be directed towards a specific portion of the target pad. Other benefits of the invention will become apparent from the description below.

In some embodiments, the target surface may comprise a target zone delineated thereon. More specifically, the target zone may comprise a sunken central area on the pad. In this way, when a gloved hand strikes the sunken central zone, the compression of air into the sunken zone makes a noise audible to the user to indicate a well-directed strike.

In certain embodiments the target zone comprises a raised central area on the pad.

In certain embodiments the target zone is a contrasting colour to the rest of the target surface.

In certain embodiments the target zone is circular. Alternatively, the target zone is square, rectangular, hexagonal or other polygonal shape.

In some embodiments, the target surface may be substantially curved or substantially planar. More specifically, the target surface can be convex, concave or flat.

In preferred embodiments the target surface is flat or concave.

In some embodiments, the largest distance across the target pad is in the range of 50 mm to 300 mm. In certain embodiments, the largest distance across the target pad is in the range of 140 mm to 180 mm. In some embodiments, the target pad has a thickness in the range of 30 mm to 300 mm. In certain embodiments, the target pad has a thickness in the range of 30 mm to 60 mm. It should be noted that the strike absorption characteristics of the material of the target pad will determine the thickness of the target pad.

In certain embodiments the target pad is of any suitable shape. More specifically, the target pad is round, square, diamond, oblong, oval, hexagon or the like.

In some embodiments, the target pad may be secured to the first arm segment only.

In some embodiments, the resiliently deformable region may comprise a resiliently deformable material such as a rubberised material, an open-cell foam or a closed-cell foam.

In some embodiments, the target pad may comprise an outer cover formed of a durable material such as leather, polyvinylchloride, vinyl or a polymerised composite. In certain embodiments the material may be any suitable material which can be welded, glued or sewn.

In some embodiments, the securing member may be secured to the first arm segment using any of a cuff, a sleeve, a bandage, a strap, a buckle or a hook and loop system.

In some embodiments, the target pad may be secured to the securing member using a releasable connection, such as mechanical fixation arrangement such as a hook and loop system, press button, magnetic fixture, button, a snap joint or a zipper.

In some embodiments, the target pad may be configured to flexibly connect to a punch mitt.

The training pad may comprise a shock absorber. The shock absorber may have a first frame member, a second frame member and a damper element connected to the first and second frame members. The first frame member may be secured relative to the first arm segment. The second frame member may be secured to the target pad. The second frame member may be configured to move relative to the first frame member upon the target pad being struck by a load. The damper element may be configured to resist relative motion between the first and second frame members so as to reduce the load transferred to the first arm segment. The damper element may comprise one or more fluid-filled elements, viscous dampers, pneumatic pistons, hydraulic pistons and resiliently deformable elements. The damper element may be configured to compress the fluid-filled element. The training pad may comprise an inner pad disposed on any of the first and/or second arm segment.

The training pad may comprise adjustment means. The target pad may comprise first and second axes extending in orthogonal directions. The first arm segment may comprise first and second axes extending in orthogonal directions. The adjusting means may be configured to secure the target pad in first and second orientations relative to the first arm segment. In the first orientation, the first axis of the pad may form first and second angles relative to the respective first and second axes of the first arm segment, and the second axis of the pad may form third and fourth angles relative to the first and second axes of the first arm segment. In the second orientation, at least one of the first, second, third or fourth angles may be different compared to when the target pad is in the first orientation. The adjustment means may set the orientation of the target pad prior to the training pad being secured to the first arm segment.

Viewed from a further independent aspect, there is provided a training pad arrangement comprising a first training pad and a second training pad configured as a training pad according to any of the embodiments described herein. The first target pad is configured to be secured to a proximal segment of the arm, and the second target pad is configured to be secured to an adjacent distal segment of the arm.

In some embodiments, the first training pad may be connected to the second training pad by any of an interconnecting web, releasable connection or an elasticated band or sleeve.

Viewed from a further independent aspect, there is provided a method of securing a training pad to an arm of a trainer, particularly a boxing trainer, for providing a target for striking, comprising the steps of providing a training pad comprising a target pad having a target surface and a resiliently deformable region located behind the target surface, and a securing member configured to secure the target pad to a first arm segment adjacent to a second arm segment, wherein the first arm segment is proximal to the second arm segment, wherein the resiliently deformable region is arranged to absorb substantially all of the energy of a strike received at the target surface, and wherein the target surface is configured to indicate to a user a strike may be made thereon, and securing the training pad to the first arm segment using the securing member such that the trainer can present the target pad for striking without contorting their torso.

Viewed from a further independent aspect, there is provided a kit of parts comprising a training pad and instructions for implementing the method of securing the training pad.

BRIEF DESCRIPTION OF THE DRAWINGS

Embodiments of the invention are further described hereinafter with reference to the accompanying drawings, in which.

DETAILED DESCRIPTION

The present invention provides a training pad that enables a trainer to present targets for striking with a significantly reduced risk of injury. Where reference is made to the "outside" or "outer" surface of the arm, this should be taken to mean the surface that is further away or more laterally displaced from a virtual centreline extending longitudinally through the torso. Where reference is made to the "inside" or "inner" surface of the arm, this should be taken to mean the surface that is closer to or more medially displaced from a virtual centreline extending longitudinally through the torso. Where reference is made to a "proximal" or "more proximal" arm segment, this should be taken to mean the arm segment that is closer to the torso when considering the standard anatomical configuration of the arm. For example, the forearm may be considered to be proximal to the hand. Alternatively, the upper arm may be considered to be more proximal than the forearm. Where reference is made to a "distal" or "more distal" arm segment, this should be taken to mean the arm segment that is further away from the torso when considering the standard anatomical configuration of the arm. For example, the hand is distal to the forearm. Alternatively, the forearm may be considered to be more distal than the upper arm.

Figure 1B:
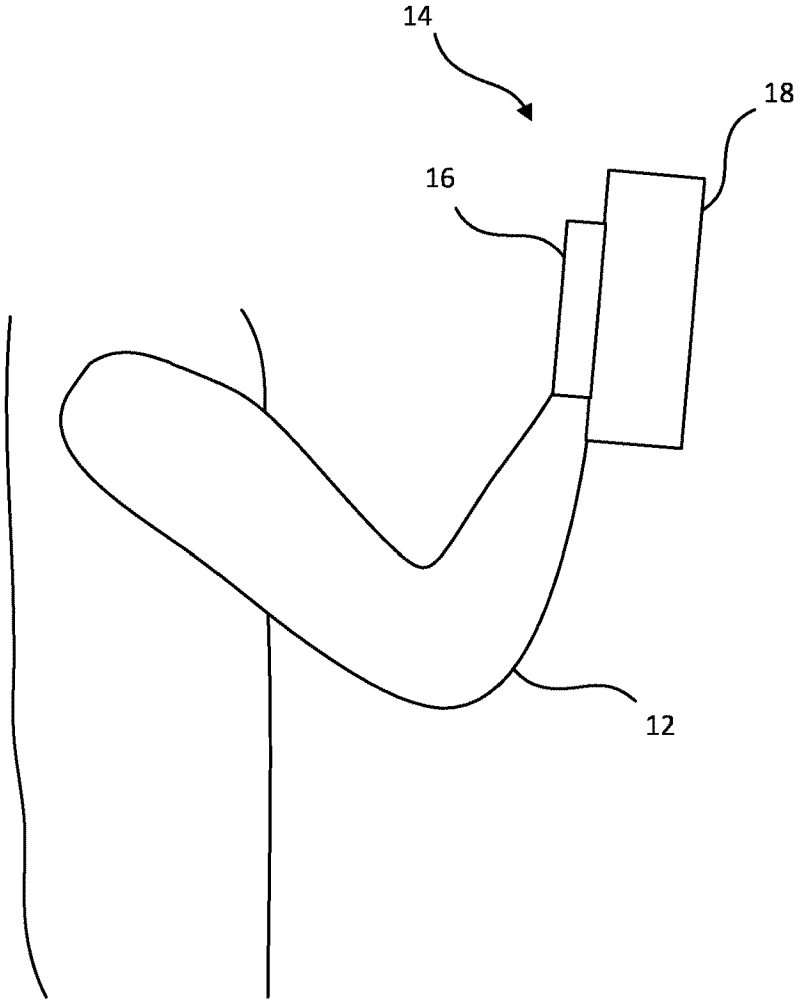
FIGS. 1A and 1B are illustrations of a trainer holding a focus mitt.
Figure 1A:
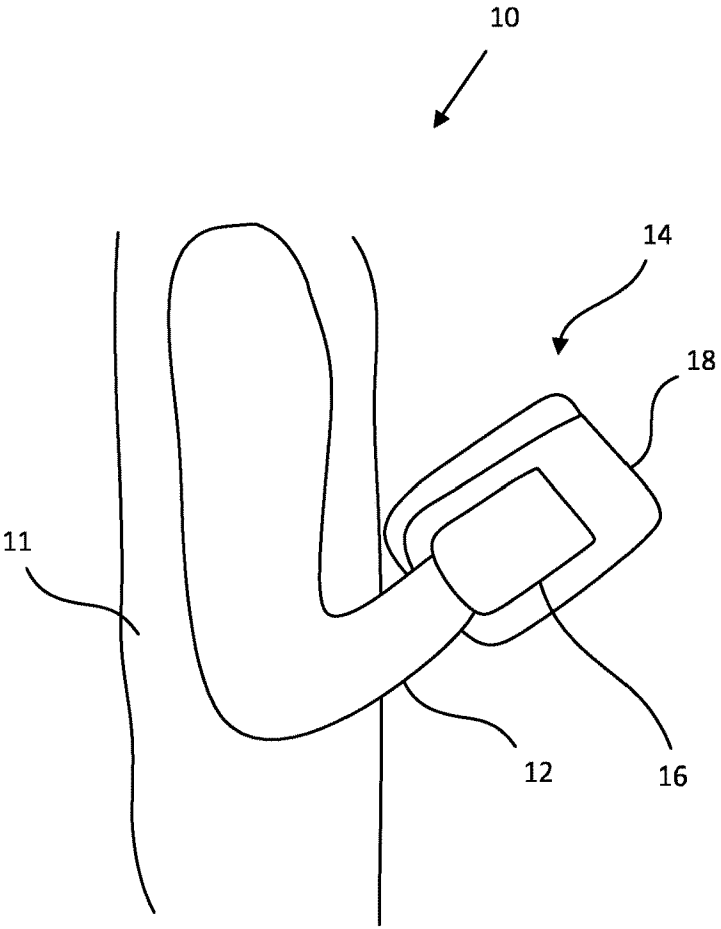

FIG. 1 shows an illustration of a trainer 10 holding a focus mitt 14. The focus mitt 14 typically comprises a padded section 18 and an embedded glove or sleeve section 16 attached to the back of the padded section. The embedded sleeve section allows the focus mitt 14 to be worn on the hand of the trainer 10. This arrangement allows the trainer to present the striking surface 18 to a trainee for striking, such as shown in FIG. 1B. Presenting the striking surface 18 typically involves raising the arm 12 of the trainer 10 to an elevated position and rotating the hand so that the striking surface 18 faces the trainee. This position informs the trainee that the striking surface 18 is being presented for them to strike. When the trainer 10 does not want the trainee to strike the striking surface 18, they will bring their arm 12 to the side of their torso 11 and turn their hand towards their torso 11, such as shown in FIG. 1A. In this position, the trainee knows that the striking surface 18 is not presented for striking. Whilst having a focus mitt on each hand of the trainer 10 provides some variation in the types of strike a trainee can perform, such an arrangement risks injuring the trainer 10, as the forces exerted onto the focus mitt 14 by the trainee will place considerable stresses on the joints, particularly the shoulder, of the trainer 10. The training pad of the present disclosure reduces the risk of joint injury the trainer 10 exposes themselves to. An exemplary training pad of the present disclosure is illustrated in FIGS. 2A to 2D.

Figure 2A:
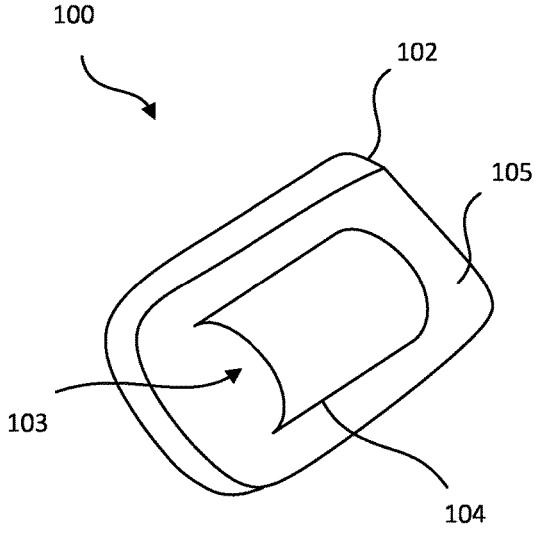
FIGS. 2A to 2F are illustrations of an exemplary training pad and constituent securing member and target pad.

FIG. 2A illustrates a training pad 100 comprising a target pad 102 and a securing member 104 secured thereto. As shown, the securing member 104 is arranged to create an opening 103 through which the arm 12 of a trainer may pass through. The securing member 104 illustrated in FIG. 2A is in the form of a single elasticated cuff or sleeve or bandage, secured to the rear side 105 of the target pad 102. When referencing the "rear" side of the target pad, this should be taken to mean the side of the target pad opposed to the target surface 110 (see also FIG. 2D). The securing member 104 may be fixedly secured to the target pad 102, for example by any combination of mechanical or chemical fixation. For example, any combination of stitching and gluing the securing member 104 to the target pad 105. While the securing member 104 is shown attached to the rear side 105 of the target pad 102, the securing member 104 may additionally or alternatively be attached to any of the other sides of the target pad 102. The securing member 104 may be secured on top of clothing covering the arm 12. The securing member 104 may be secured directly onto the skin of the arm 12. In this case, the securing member may be considered to be in direct contact with the arm 12.

Figure 2B:
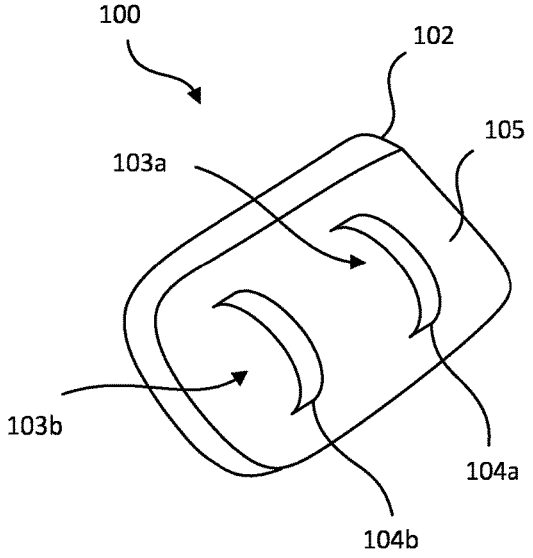

Alternatively, the securing member 104 may comprise a plurality of cuffs or straps 104A, 104B such as shown in FIG. 2B. Each of the straps or cuffs may create an opening 103*a*, 103B for the arm 12 of the trainer 10 to pass through. A plurality of cuffs has the further advantage of offering the trainer 10 more locations on which to secure the training pad 100. For example, a first cuff 104A may secure the forearm of the trainer 10 within a first opening 103A. A second cuff 104B may secure the upper arm of the trainer 10 within a second opening 103B. This arrangement has the advantage of being able to locate the target over the elbow joint of the arm 12. This option is not easily available to the trainer 10, as strapping across the elbow joint would cause discomfort to the trainer 10 due to the cuff material bunching as the elbow is flexed and extended, as is typically performed when presenting a focus mitt 14 for striking during training. Whilst a first 104A and second 104B arrangement are disclosed as being suitable for locating the target pad 102 over the outside of the elbow joint, it would be appreciated that other configurations of securing member 104 may be equally suitable. The securing member 104 may be configured to locate the target pad 102 over the outside of the upper arm, for example over the outside of the bicep muscle. The securing member 104 may be configured to locate the target pad 102 over the outside of the forearm, for example over the outside of the extensor muscles of the hand and wrist. The securing member 104 may be configured to locate the target pad 102 over the inside of the forearm, for example over the outside of the flexor muscles of the hand and wrist. The plurality of cuffs may be elasticated so the trainer 10 may easily put on and take off the training pad 100. A further advantage of such a fixation method is that the trainer is provided with a more comfortable fit. It would be understood by the skilled person that combinations of the securing members 104 are equally suitable for the present training pad 100. For example, an elasticated strap with a hook and loop arrangement located thereon may be used to secure the training pad 100 to the arm 12 of the trainer 10. The securing member 104 may be made from a neoprene material. The securing member 104 may comprise one or more buckles to secure the securing member to the arm 12 of the trainer 10. The securing member 104 may comprise a web of material to secure the securing member 104 to the arm 12 of the trainer 10.

Figure 2C:
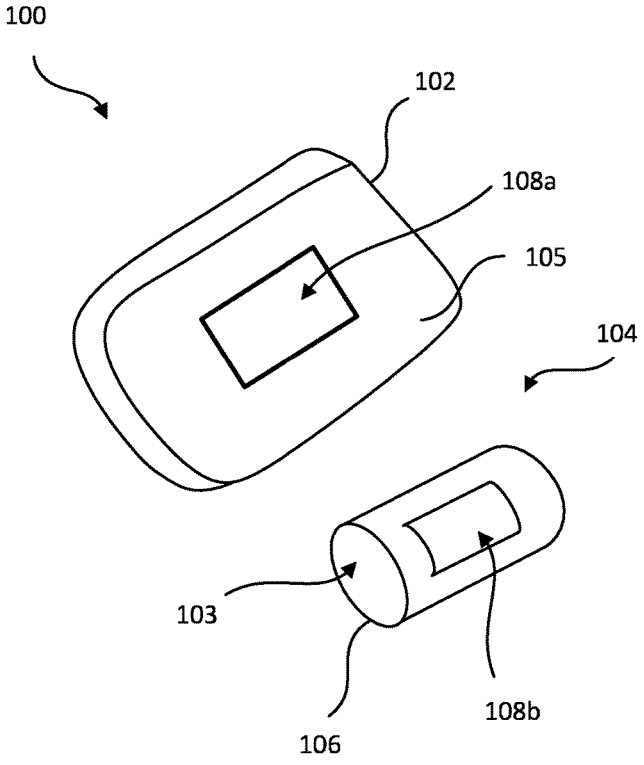

FIG. 2C illustrates a detachable training pad 100. In this case, the target pad 102 may be separated from the securing member 104. This embodiment may be advantageous, as the trainer 10 may be able to swap out target pads 102 without needing to remove the entire training pad 100 from their arm. This may be particularly beneficial if the trainer 10 is wearing a focus mitt 14 and training pad 100 at the same time. Such an arrangement provides the trainer 10 with the ability to swap target pads 102, for example to use a heavier pad for stronger trainees or a lighter pad for weaker trainees. A target pad 102 may need swapping for hygiene reasons, for example if considerable amounts of sweat has contacted the surface of the target pad 102. A trainer 10 would then be able to exchange the used target pad 102 for a clean pad without having to completely remove the training pad 100. One way of providing a target pad 102 that is detachable from the securing member 104 is to use a mechanical fixation system, such as a hook and loop system, one or more snap joints such as a snap button, or one or more zippers. A first engaging portion 108*a* secured to the target pad 102 may engage with a second engaging portion 108*b* secured to the securing member 104. For example, an area of hooks may be provided as the first engaging portion 108*a* and a corresponding area of loops may be provided as the second engaging portion 108*b*. This would allow the trainer 10 to quickly attach or detach a target pad 102 during a training session. While the securing member 104 for this embodiment is illustrated as a single cuff, it would be understood by the skilled person that this is merely exemplary and that other securing members 104 described herein may be equally suitable.

Figure 2D:
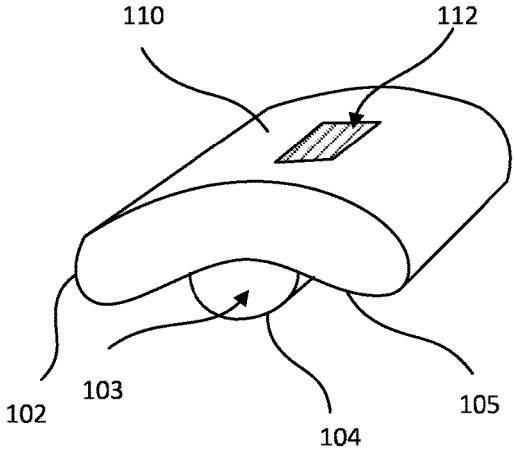

FIG. 2D illustrates an alternative training pad 100 having a curved target pad 102 with a corresponding curved target surface 110 with a target zone 112 delineated thereon. The presence of a delineated target zone 112 has independent advantages. Firstly, the quality of the training provided by the trainer 10 is enhanced, as the trainee given a more focused location to strike and with repeated strikes, this will improve their accuracy. The delineated target zone 112 provides further benefit to the trainer, as the controlled location of the strikes allows the trainer to better prepare themselves for each strike. Without a delineated target zone 112, the trainer would have to brace against each strike in an arbitrary manner. With a delineated target zone 112, the trainer knows more accurately how they should brace before the strike. The target zone 112 may be delineated by lettering, such as an "X". The target zone 112 may be delineated by markings, such as a circle or square. The target zone 112 may be delineated by colouring, such as a two-tone colour scheme on the target surface 110. The target zone 112 may be delineated by surface contours, such as one or more ridged or elevated portions or depressions formed as part of the target surface or attached to the target surface. Any combination of these features may be used to delineate the target zone and indicate to the trainee where to strike the target pad. While a convex target surface 110 is illustrated in FIG. 2D, the target surface 110 may be a concave surface. Such an embodiment would allow for the glove of a trainee to be guided towards the target zone 112 and provide feedback to the trainee on the accuracy of their strike. For example, if the trainee hit the target zone 112 "cleanly", that is to say, without feeling any shifting of their hand after striking the target pad 102, this would feed back to the trainee they had struck the target pad 102 cleanly. If there is significant movement of the trainee's hand after they strike the target pad 102, this would let the trainee know the strike was not sufficiently accurate. Whilst providing the trainee with feedback on the accuracy of the strike, the force of the strike will also be directed to the target zone 112, where the resiliently deformable material behind the target zone 112 is able to optimally absorb the energy of the strike, thereby protecting the trainer from having to endure excessive forces during the training session.

As shown, the rear side 105 of the target pad 102 is also curved. This allows for greater conformity with the arm 12 and provides a more secure and comfortable fit to the trainer. While the target pad 102 is shown with a curved rear side 105, this is optional. The target pad 102 may comprise a flat rear side 105 and curved target pad 102. The target pad 102 may comprise a curved rear side 105 and flat target pad 102. The target pad 102 may comprise a flat rear side 105 and a flat target pad 102. Any of the target surface 110 or rear surface 105 may be substantially curved, for example forming a substantially convex or concave surface. A concave target surface will present an inviting target for the striker. Where a surface is defined as being substantially flat, this should be taken to mean substantially planar. An exemplary target pad has a circumference of 18 cm.

The target pad 102 may have similar dimensions to a hand-held focus mitt 14. The largest distance across the target pad 102 may be in the range of 50 mm to 300 mm. The largest distance across the target pad 102 may be in the range of 140 mm to 180 mm. The thickness of the target pad 102 may be in the range of 30 mm and 300 mm. The thickness of the target pad 102 may be in the range of 30 mm and 60 mm. The thickness of the target pad 102 may be similar to that of a focus mitt 14. The target pad 102 will typically absorb a large proportion of the energy of a strike so as to minimise the energy transferred to the trainer 10. One way of achieving this is to incorporate a resiliently deformable material within the target pad 102. The resiliently deformable material may be any of: air, a rubberised material, an open-cell foam and a closed-cell foam. The target pad 102 may comprise a fluid-filled layer. The fluid-filled layer may comprise a gel or similar such material configured to substantially dissipate the energy of the strike. The resiliently deformable material would help absorb the energy of the strikes and reduce the loads transferred to the trainer 10. The target pad 102 may be contained within an outer cover (not shown) formed of a durable material such as leather, polyvinylchloride, vinyl or a polymerised composite. This advantageously allows the target pad 102 to be contained within a durable material which is substantially waterproof and can be cleaned simply by wiping down or washed separately from the target pad 102. This provides a lightweight and durable training pad. The securing member 104 may be attached to the outer cover. The target pad 102 may have a substantially circular or rectangular cross-section. Whilst it may be preferable to have a target pad 102 with a rectangular or circular cross section, it would be understood by the skilled person that a circular and rectangular cross-section are provided merely as examples and that other shapes of target pad 102, including irregular shapes, are equally included by this description (see also FIGS. 3A to 3D).

Figure 2E:
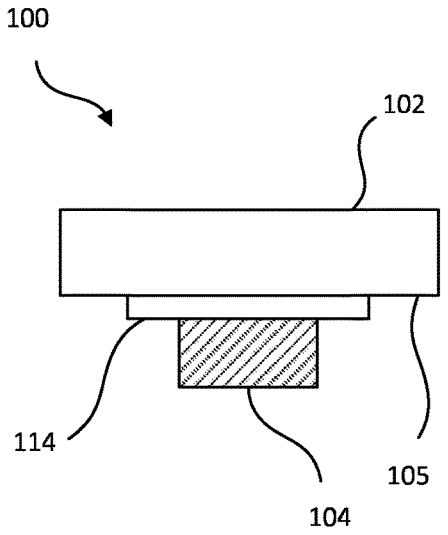
Figure 2F:
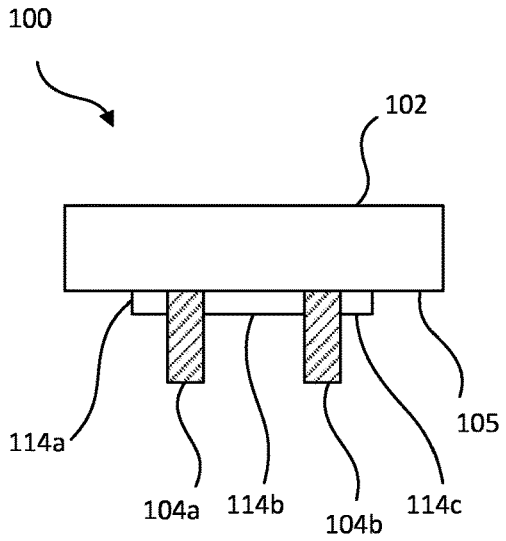

As illustrated in FIGS. 2E and 2F, the training pad 100 may comprise a second pad 114 secured to the target pad 102 to provide further protection to the trainer 10 as the target surface 110 is struck. The second pad 114 may be secured to the rear side 105 of the target pad 102 and be considered an inner pad. In the example illustrated in FIG. 2E, the target pad 102 is secured to the second pad 114 and the second pad 114 is secured to the trainer 10. In the example illustrated in FIG. 2F, the second pad 114 is formed of three parts 114*a*, 114*b*, 114*c* which are disposed between and around straps 104*a*, 104*b* which secure the target pad 102 to the trainer 10. The second pad 114 may be disposed within a second covering (not shown). The second pad 114 may be secured to the target pad 102 or the securing member 104 or, when present, the second covering by means described elsewhere in this specification.

In one example, the training pad 100 comprises adjustment means (not shown) to enable the trainer 10 to adjust the orientation of the target pad 102 relative to the arm segment to which the target pad 102 is secured. This is desirable, as the trainer 10 is then able to secure the securing member 104 once and configure the target pad 102 depending on the training to be delivered. In one example, the trainer 10 may set the target pad 10 in a first orientation to receive strikes from a first direction and change the orientation of the target pad 102 using the adjustment means to receive strikes from a second direction different from the first direction. This is advantageous, as the trainer 10 is able to provide targets for striking from multiple directions whilst remaining in a biomechanically stable position. The adjustment means may comprise any of an adjustable hinge, a spherical bearing, a rotary bearing, a linear bearing or a gimbal. The adjustment means may further comprise locking means to secure the target pad 102 in the first and second orientations. The locking means may comprise any of a clamp or a set screw to secure the target pad 102 in the first or second orientation.

In an example, the trainer 10 may set the target pad 102 on the lateral side of the upper arm 12*a* with the target pad 102 positioned at a first height on the upper arm 12*a* so a trainee can deliver strikes at a first height. The trainer 10 may then set the target pad 102 at a different height, for example a lower height than before, so that the trainee can deliver strikes at a second height.

Figure 2G:
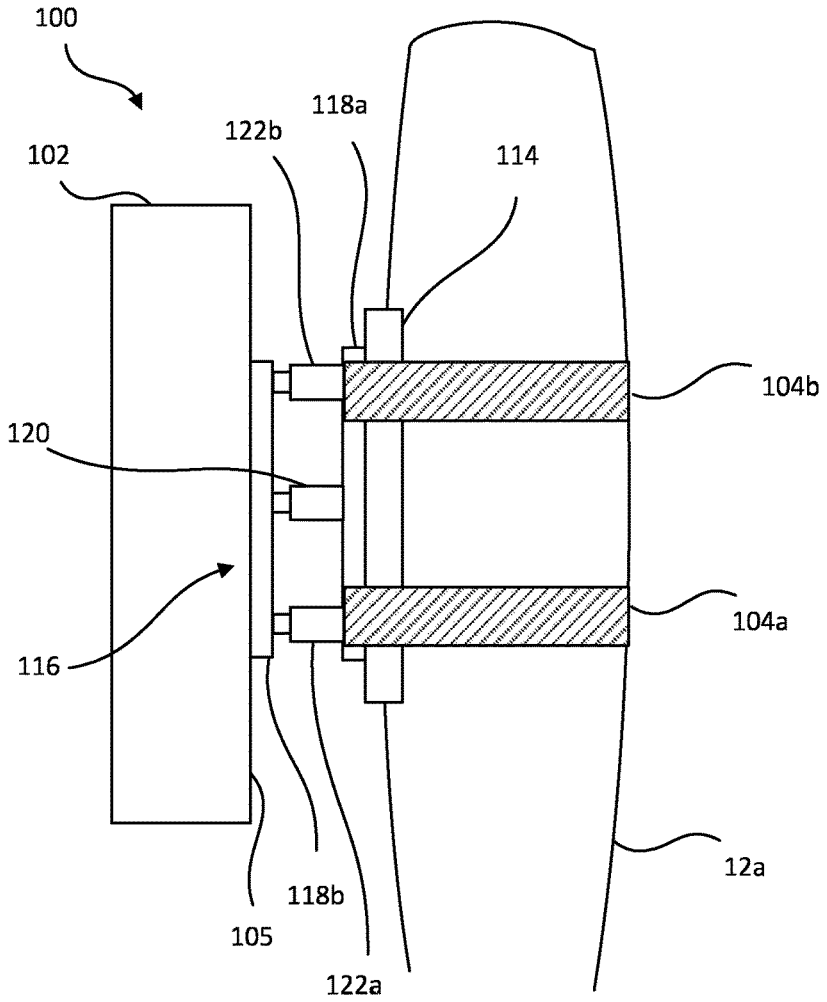
FIG. 2G is an illustration of an exemplary training pad including a shock absorber.

In the example illustrated in FIG. 2G, the training pad 100 comprises a shock absorber 116 configured to distribute the energy of the strike away from the specific point of impact, so as to reduce the load transferred to the trainer's arm 12 directly under the point of impact of the strike. The shock absorber 116 typically includes a frame that directs energy away from the target zone 112. In one example where the target pad 102 is secured over the upper arm 12*a* using straps 104*a*, 104*b*, the frame 118 may be sufficiently stiff to more evenly distribute the force of the strike at the target zone 112 across a greater area of the upper arm 12*a*. The frame 118 is preferably configured to absorb some of the impact even in the absence of a shock absorber 120. In the illustrated example, the frame 118 comprises a first frame member 118*a* and a second frame member 118*b* and, for example, a piston 120 connected to the first 118*a* and second 118*b* frame members. The first frame member 118*a* is secured to the target pad 102 and the second frame member 118*b* is secured to the securing means 104. The piston 120 is thus able to dissipate energy as the first frame member 118*a* moves relative to the second frame member 118*b*. The shock absorber 116 is also shown comprising two linear bearings 122*a*, 122*b* to facilitate translation of the first frame member 118*a* relative to the second frame member 118*b*. It would be understood the linear bearings 122*a*, 122*b* were not essential to the invention. To aid comfort, and to further reduce the force of the impact, a second pad 114 can be provided between the upper arm 12*a* and the frame 118 of the training pad 100. While a frame comprising distinct first 118*a* and second 118*b* frame members is illustrated, it would be apparent this was merely an exemplary frame. A rigid cuff that circumscribes a portion of the trainer's arm would provide some advantages of the present training pad 100. It would be apparent that two or more damping elements 120 may be used to provide particular damping characteristics for a given training pad 100.

In an alternative example, the shock absorber 116 is secured within the target pad 102. In this case, the first frame member 118*a* may be directly or indirectly secured to the target surface 110 and the second frame member 118*b* may be directly or indirectly secured to the rear surface 105. For example, the first frame member 118*a* may be secured to a pad disposed between the target surface 110 and the first frame member 118*a*. For example, the second frame member 118*b* may be secured to a pad disposed between the rear surface 105 and the second frame member 118*b*. Further padding may be disposed between the first 118*a* and second 118*b* frame member to further reduce the impact transferred to the trainer 10. When contained within the target pad 102, the shock absorber 116 may be used in combination or conjunction with the resiliently deformable member described elsewhere in this specification to absorb the load of strikes onto the target pad 102. Locating the shock absorber 116 within the target pad 102 would also provide a training pad 100 that looks like a standard training pad, for example in terms of its size and depth, but offer much greater resistance to strikes by a trainee. Internalising the shock absorber 116 in the described manner also reduces the risk of the components of the shock absorber 116 being exposed or damaged in use.

It is desirable to incorporate a shock absorber 116 in a training pad 100, as standard foam used in focus mitts typically provide a linear response as the foam is deformed. In contrast to this, a shock absorber 116, which may contain hydraulic elements such as a dash-post, can provide considerably more resistance upon initial contact with the target pad 102, thus dissipating the energy of the strike more efficiently than a foam-filled pad. As there is less deformation required to dissipate substantially all of the energy, the thickness of the present training pad 100 is also reduced compared to equivalent pads. This provides a training pad 100 having the manoeuvrability of a focus mitt, but the dissipative properties of a much larger strike bag. This further helps to reduce the risk of injury to the trainer 10 as they are less fatigued from training, which in turn means they are able to present targets to trainees in a more accurate manner, thus ensuring strikes are delivered in a safe way.

In an example, a frame 118 may be mounted to a sleeve (not shown) worn by the trainer 10. The sleeve and/or the frame 118 may incorporate one or more damping elements 120, such as a pneumatic or hydraulic piston integrated therein. The training pad 100 would thus be able to receive powerful strikes with minimal load being transferred to the trainer 10. The frame 118 is preferably made from a rigid and lightweight material. One such material may comprise laminated carbon fibre sheets, for example carbon fibre reinforced polymer. The rigid material may comprise aluminium or aluminium alloys. The adjustable means may be set before the trainer 10 puts on the training pad 100. For example, a hinge in combination with pistons 120 of different stroke lengths may be used to set the initial orientation of the target pad 102. The piston 120 typically comprises a piston head arranged in a piston shaft having opposed first and second ends. The piston head may be biased to have a rest position at an end of the respective piston shaft. Using as much of the stroke length as possible provides a greater amount of damping. In other examples, the spring, or similar such member, may be tuned so that the piston head has a rest position at a location between the first and second ends. Providing a piston 120 with less travel reduces the depth of the training pad 100. Where more than one piston 120 is used, each piston 120 may be tuned such that the target pad 102 is set to a predetermined angle relative to the arm 12 of the trainer 10. In one example, an the target pad 102 may be rotated about a first axis such that an end of the target pad 102 nearest the proximal end of the arm may be displaced further from the arm than the distal end or vice versa. In an other example, the target pad 102 may be rotated around a second axis parallel to a longitudinal axis of the arm 12 and passing through the training pad 100. The first axis and second axis may be as described above. The first axis and second axis may lie in a plane substantially parallel with the target surface 110 of the target pad 102.

Figure 3A:
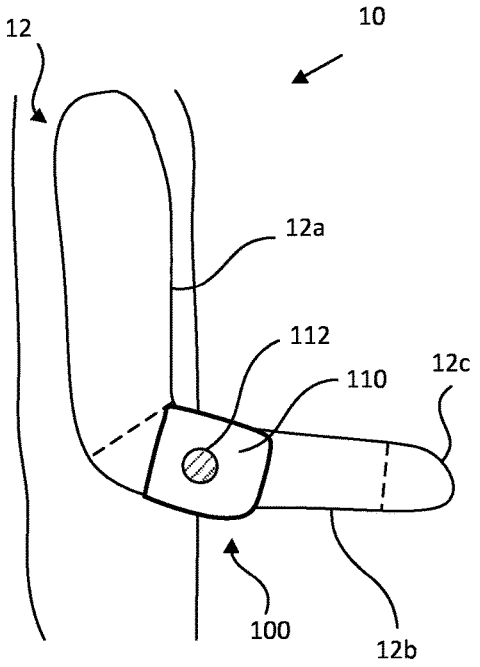
FIGS. 3A to 3D are illustrations of exemplary arrangements of the training pad when secured to an arm of the trainer.
Figure 3B:
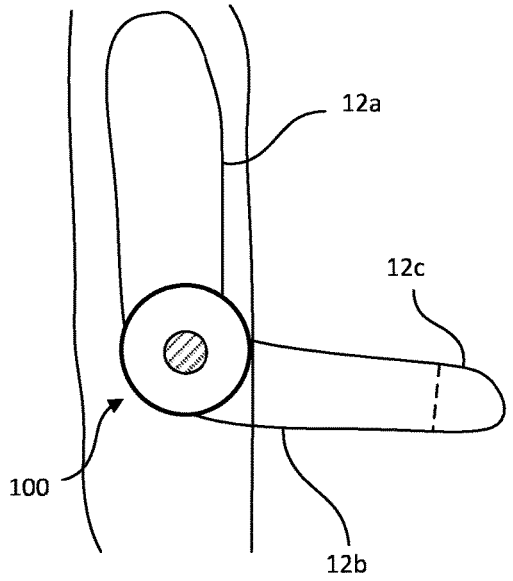
Figure 3C:
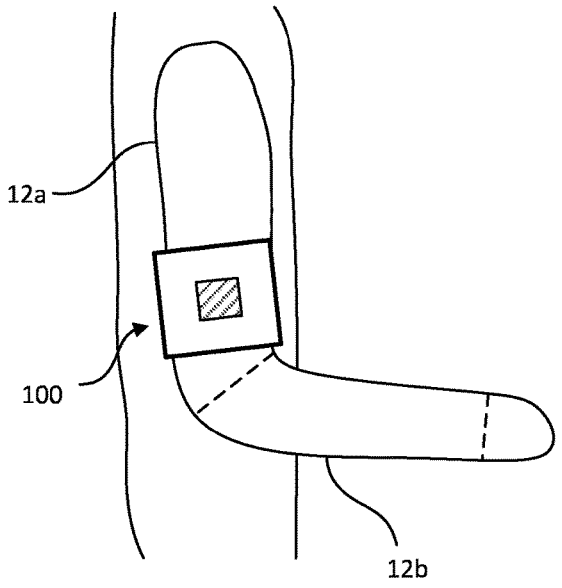

FIGS. 3A to 3D illustrate exemplary arrangements of the training pad 100 when secured to the arm 12 of the trainer 10. As shown in FIGS. 3A to 3D, the arm 12 can be considered as three interconnected proximal 12*a*, intermediate 12*b* and distal 12*c* arm segments. In the case of the arm, the upper arm corresponds to the proximal arm segment 12*a*, the forearm corresponds to the intermediate arm segment 12*b* and the hand corresponds to the distal arm segment 12*c*. The training pad 100 is preferably worn on the outside of the upper arm 12*a* or forearm 12*b*, near the elbow joint (not shown). This allows the trainer 10 to present the trainee with a target zone 112 corresponding to a body shot having resistance, for example, by placing their upper arm 12*a* against their torso 11. This is particularly advantageous, as previously, the trainer would have had to contort their torso 11 and arms 12 to provide a body shot target. The training pad 100 of the present disclosure gives the trainer 10 the option of presenting a body shot target without needing to contort their torso 11 and whilst also providing greater resistance compared to using existing target mitts. This helps to minimise the risk of injury to the trainer 10, as they are in a considerably better position, biomechanically, to receive a strike. The flexibility offered by the securing member 104 also enables the trainer 10 to locate the training pad accordingly, so as to ensure they are in a safe position when receiving strikes. The target pad 102 may be located over the outside of the forearm 12*b*, such as shown in FIG. 3A. Alternatively, the target pad 102 may be located over the inside of the forearm 12*b*. This would allow the trainer 10 to do away with the need for focus mitts 14, as a target pad 102 located over the inside of the forearm 12*b* may be presented to the trainee for striking in a similar manner to a focus mitt 14. The target pad 102 may be located over the outside of the elbow joint, such as shown in FIG. 3B. The target pad 102 may be located over the outside of the upper arm 12*a*, such as shown in FIG. 3C. Further, a delineated target zone 112 helps to guide the strikes to a particular location on the target surface 110. Without the delineated target zone 112, a trainee may strike the target surface 110 inaccurately and miss altogether, accidentally striking the trainer 10. However, with a delineated target zone 112, if the trainee misses the target zone 112, it is likely they will at least strike the target surface 110, which will shield the trainer 10 from the strike.

Figure 3D:
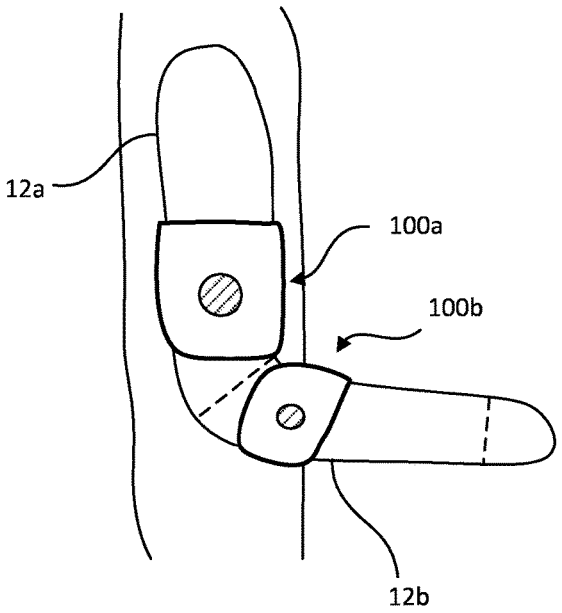

As shown in FIG. 3D, it is possible to utilise a first training pad 100*a* secured to the upper arm 12*a* and a second training pad 100*b* secured to the forearm 12*b*. Offering a plurality of target pads 102 enables the trainer 10 to provide a yet further combination of targets for the trainee to strike. For example, the first training pad 100*a* may be used to present a target for striking from a lateral direction, whereas the second training pad 100*b* may be used to present a target for a strike from a frontal direction. The first training pad 100*a* may be secured to the second training pad 100*b* by a connecting member. The connecting member may be flexible and allow unimpeded movement of the arm 12. The connecting member may comprise a web of material.

Figure 4B:
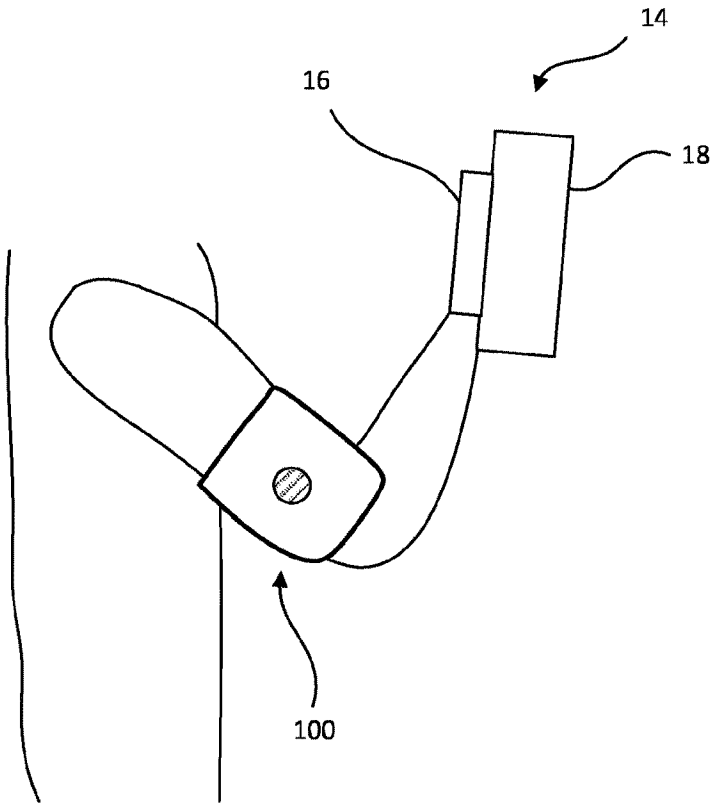
FIGS. 4A to 4C are illustrations of an exemplary arrangement where the training pad and a focus mitt are worn by the trainer.
Figure 4A:
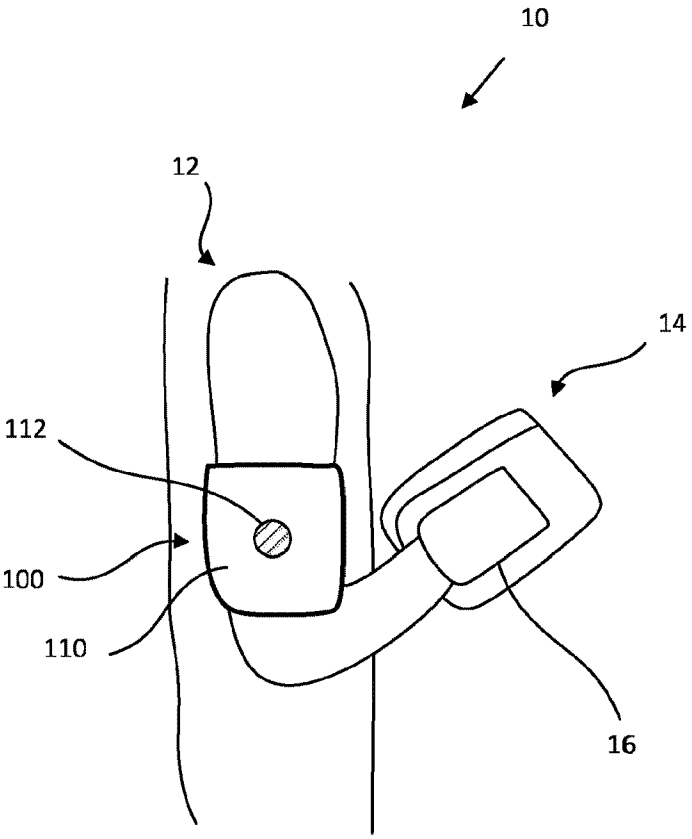
Figure 4C:
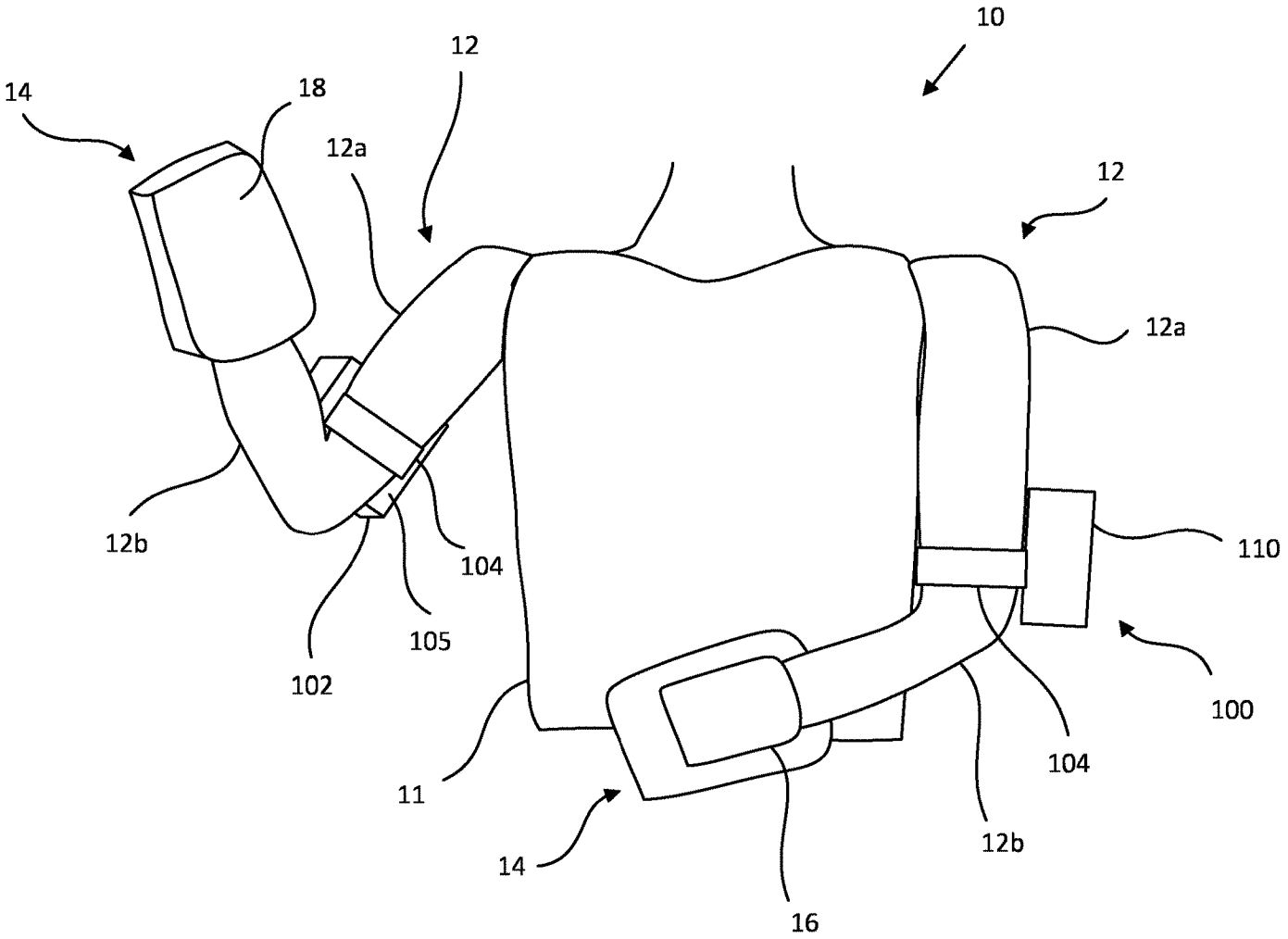

FIGS. 4A to 4C illustrate an exemplary arrangement where the training pad 102 and a focus mitt 14 are worn by the trainer 10. As shown in FIG. 4A, a training pad 100 is attached to the upper arm and a focus mitt 14 is attached to the hand 12*c* of the trainer 10. By securing the training pad 100 to an arm segment more proximal than the hand 12*c*, the hand 12*c* of the trainer 10 remains free to hold a focus mitt 14 or other training aid. Previously, and without the training pad 100 of the present disclosure, when the arm 12 of the trainer 10 was in the illustrated position, the trainee would have known that there was no target being presented. However, using the training pad 100 of the present disclosure, the trainer 10 can present the trainee with a target from this position. This allows the trainee to incorporate body strikes into the training session which provides the trainee with a more varied training session.

A further advantage of the training pad 100 of the present disclosure is the ability of the trainer 10 to support themselves to a much greater extent than with focus mitts 14 when receiving strikes. As the target pad 102 is located on the outside of the arm, the trainer 10 is able to support their upper arm with their torso 11 to brace against the impact of the strike to the target surface 110 (as shown in FIG. 4C). The training pad 100 does not require the trainer 10 to extend their arms or contort their body to present a target corresponding to a body shot having a resistance comparable to striking a person's torso, which would have placed the trainer in a biomechanically unfavourable position to brace against the impact of the strike. The present training pad 100 reduces the risk of injury to the trainer whilst providing the trainee with greater variety in their training. By providing the option of a body shot in a safe manner, the trainer 10 is not only reducing the damage to their body due to the impacts of strikes, but is also able to reduce the proportion of strikes that are received with the arms in an extended position.

As shown in FIGS. 4A to 4C, the training pads 100 may be used in combination with a focus mitt 14 to provide a greater variety of targets. As the training pad 100 leaves the hands 12*c* of the trainer 10 free, this gives the trainer the option to include further targets on the focus mitt 14. Additionally, the trainer and trainee may develop new positions which would indicate to a trainee there were one or more targets presented for striking. For example, starting from the position in FIG. 4A, the trainer 10 may open their hand to present the focus mitt 14 as an additional target for the trainee to strike either from a lateral direction or from a frontal direction. This would enable the trainer to develop new combinations of strikes, further improving the quality of training. As the training pad 100 can be secured to the arm 12 such that the target surface 110 can be secured over the outer surface or the inner surface of the arm 12, the training pad 100 is equally suitable for trainers and trainees who adopt an Orthodox stance or a Southpaw stance. This provides a trainer with the flexibility to use the same training pad 100 regardless of the type of trainee they are training.

The training pad 100 may be connected to the focus mitt 14 by a connecting member (not shown). The connecting member may be a flexible sleeve or web of material. A flexible connecting member provides the advantage of securing the focus mitt 14 to the training pad 100 whilst not impeding the movement of the wrist and elbow of the trainer. Whilst the combination of a training pad 100 and focus mitt 14 are particularly advantageous, it would be apparent that the training pad 100 alone provides significant advantages and that the focus mitt 14 is not essential to achieving the benefits of the present training pad. An important aspect of the training pad 100 is the lightweight and robust design. This allows the trainer 10 to have a target pad 102 attached to their arm 12 without hindering their ability to move and simulate the dynamic environment of competition. The training pad 100 is able to provide many new targets and combinations of strikes for a trainee, whilst significantly reducing the risk of injury to the trainer 10.

In use of the target pad of the invention, the trainer may inform the trainee where to strike and will place the target pad ready to receive the strike.

In an example, the training pad 100 comprises a sensor module (not shown) having at least one sensor configured to measure workout data. Workout data may include any combination of number of punches, punch force, punch speed, punch accuracy, punch rate (e.g. number of punches per unit time), punch type, workout duration, punch strength (e.g. punch force per unit weight), fatigue (e.g. current punch force compared to an average of earlier punches). Any combination of force transducers, pressure sensors, inertial measurement units (IMUs) and gyroscopes known in the art would be suitable for measuring the workout data. The sensor module may comprise a sensor processor in data communication with the sensor(s) and, optionally, in data communication with a remote processor. The remote processor may be comprised within any of a handheld device, a wearable device, a data logger, a laptop, a mobile phone, a tablet, an external display, a speaker, a remote server. The sensor processor is typically in data communication with a non-volatile memory and is configured to store data indicative of the measured workout data on the non-volatile memory. The non-volatile memory may be an onboard memory of the sensor processor or be a removable memory such as a memory storage card or memory stick. The sensor module may comprise data communication means. The data communication means may be configured to transmit data to the remote processor over a wired or wireless connection. The data communication means may comprise a data port (e.g. an ethernet connection, a universal serial bus (USB) connection, a serial connection), and/or a wireless transceiver configured to communicate over, for example, a Bluetooth connection, an infrared connection, a mobile telecommunications network (e.g. 2G, 3G, 4G, 5G), a local area network, a wide area network. The sensor processor may be configured to transmit data during and/or after a workout. The workout data may be downloaded or transmitted following a user input to the sensor module, the remote processor or a further device in data communication with the sensor module or the remote processor. The sensor processor and/or the remote processor may comprise a log of other workouts and output data relative to the other workouts. The workout data may be viewed in a mobile application stored on the sensor processor and/or the handheld device. This may be useful if a trainee wanted to compare their current workout with their previous workout, or that of a different person or a generic workout. The sensor processor and/or remote processor can thus output a relative measure, e.g. "30% increase in force" or "5% longer workout". The sensor processor and/or remote processor may output any combination of measured and/or calculated punch characteristics (e.g. 10% increase in maximum punch force over the last 2 weeks, 20% decrease in punch accuracy on average today compared to last week, 4% higher rate of fatigue today compared to last week). Providing such functionality in a training pad greatly increases the motivation for the trainee as they are able to quantify their progress over time.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. An arm training pad for preventing injury to a trainer, in particular a boxing trainer, when presenting the arm training pad for striking, comprising:

a curved target pad having a convex target surface and a resiliently deformable region located behind the convex target surface, wherein a rear side of the curved target pad is also curved, forming a substantially concave surface to correspond with the convex target surface, and a securing member configured to secure the target pad to a first arm segment adjacent to a second arm segment, wherein the first arm segment is proximal to the second arm segment, wherein the resiliently deformable region is arranged to substantially absorb the energy of a strike received at the target surface, and wherein the target surface comprises a target zone thereon, wherein the target zone indicates to a user a strike may be made thereon, wherein the largest distance across the target pad is in the range of 50 mm to 300 mm, wherein the thickness of the target pad is in the range of 30 mm to 300 mm, wherein the target pad is configured to be secured to the first arm segment only, and wherein the resiliently deformable region comprises a resiliently deformable material selected from one of a rubberised material, an open-cell foam or a closed-cell foam.

2. The arm training pad according to claim 1, wherein the target pad comprises an outer cover formed of a durable material selected from one of leather, polyvinylchloride, vinyl or a polymerised composite.

3. The arm training pad according to claim 1, wherein the securing member is secured to the first arm segment using any one of a cuff, a sleeve, a bandage, a strap, a buckle or a hook and loop system.

4. The arm training pad according to claim 1, wherein the target pad is secured to the securing member using a releasable connection, selected from one of a hook and loop system, a snap joint or a zipper.

5. The arm training pad according to claim 1, wherein the target pad is configured to flexibly connect to a punch mitt.

6. A method of securing an arm training pad to an arm of a trainer, particularly a boxing trainer, for providing a target for striking, comprising the steps of:

providing an arm training pad comprising a curved target pad having a convex target surface, wherein a largest distance across the target pad is in the range of 50 mm to 300 mm, and a thickness of the target pad is in the range of 30 mm and 300 mm, the curved target pad comprising a resiliently deformable region located behind the target surface and a curved rear side forming a substantially concave surface to correspond with the convex target surface, the resiliently deformable region having a resiliently deformable material selected from one of a rubberised material, an open-cell foam or a closed-cell foam, wherein the target pad has a securing member configured to secure the target pad to a first arm segment adjacent to a second arm segment, wherein the first arm segment is proximal to the second arm segment, wherein the target pad is configured to be secured to the first arm segment only, wherein the resiliently deformable region is arranged to absorb substantially all of the energy of a strike received at the target surface, and wherein the target surface comprises a target zone thereon, wherein the target zone is configured to indicate to a user a strike may be made thereon, and securing the arm training pad to the first arm segment using the securing member such that the trainer can present the target pad for striking without contorting their torso.

7. The arm training pad according to claim 1, wherein the target zone is delineated by one or more of: lettering, markings, colouring, surface contours and depressions.

8. An arm training pad for preventing injury to a trainer, in particular a boxing trainer, when presenting the arm training pad for striking, comprising:

a target pad having a substantially curved target surface and a resiliently deformable region located behind the target surface, and a securing member configured to secure the target pad to a first arm segment adjacent to a second arm segment, wherein the first arm segment is proximal to the second arm segment, wherein the resiliently deformable region is arranged to substantially absorb the energy of a strike received at the target surface, and wherein the target surface is configured to indicate to a user a strike may be made thereon, wherein the thickness of the target pad is in the range of 30 mm to 300 mm, wherein the target pad is configured to be secured to the first arm segment only, wherein the resiliently deformable region comprises a resiliently deformable material selected from one of a rubberised material, an open-cell foam or a closed-cell foam, and wherein the arm training pad further comprises a shock absorber having a first frame member, a second frame member and a damper element connected to the first and second frame members, wherein the first frame member is configured to be secured relative to the first arm segment, wherein the second frame member is secured to the target pad, wherein the second frame member is configured to move relative to the first frame member upon the target pad being struck by a load, and wherein the damper element is configured to resist relative motion between the first and second frame members so as to reduce the load transferred to the first arm segment.

* * * * *